US007836540B2

(12) United States Patent
Vasilakes et al.

(10) Patent No.: US 7,836,540 B2
(45) Date of Patent: Nov. 23, 2010

(54) BROOM WITH PARTICLE CAPTURE SHEET

(75) Inventors: Lloyd S. Vasilakes, Stillwater, MN (US); Scott J. Tuman, Woodbury, MN (US); Gretchen A. Hauble, Dellwood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 537 days.

(21) Appl. No.: 11/832,752

(22) Filed: Aug. 2, 2007

(65) Prior Publication Data

US 2009/0031509 A1 Feb. 5, 2009

(51) Int. Cl.
*A47L 13/40* (2006.01)
*A47L 13/42* (2006.01)
*A47L 25/00* (2006.01)

(52) U.S. Cl. ..... 15/114; 15/1.52; 15/104.002; 15/104.8

(58) Field of Classification Search ..... 15/105, 15/110, 114, 115, 117
See application file for complete search history.

(56) References Cited

U.S. PATENT DOCUMENTS

| | | | | |
|---|---|---|---|---|
| 2,673,547 | A * | 3/1954 | Hummel | 118/268 |
| 2,715,742 | A * | 8/1955 | Coles | 15/105 |
| 3,619,845 | A * | 11/1971 | Partridge et al. | 15/117 |
| 3,676,888 | A * | 7/1972 | Akers | 15/245 |
| 4,215,682 | A | 8/1980 | Kubik et al. | |
| 5,461,749 | A | 10/1995 | Ahlberg et al. | |
| 5,792,242 | A | 8/1998 | Haskett | |
| 5,903,948 | A | 5/1999 | Williams et al. | |
| 6,513,184 | B1 | 2/2003 | Brown et al. | |
| 6,705,792 | B2 | 3/2004 | Smith | |
| 6,745,434 | B2 | 6/2004 | Smith et al. | |
| 7,181,801 | B1 | 2/2007 | Kresse et al. | |
| 7,203,988 | B2 | 4/2007 | Laux et al. | |
| 7,234,193 | B2 | 6/2007 | Tanaka et al. | |
| 2002/0100494 | A1 * | 8/2002 | Brown et al. | 134/6 |
| 2005/0136766 | A1 | 6/2005 | Tanner et al. | |
| 2005/0144749 | A1 | 7/2005 | Yamada | |
| 2005/0171051 | A1 | 8/2005 | Bergsten et al. | |
| 2005/0198757 | A1 * | 9/2005 | Gavney et al. | 15/114 |
| 2006/0096051 | A1 * | 5/2006 | Akai et al. | 15/104.93 |
| 2006/0240223 | A1 | 10/2006 | Tuman et al. | |

FOREIGN PATENT DOCUMENTS

DE 10 2005 022 948 B3 3/2007

* cited by examiner

*Primary Examiner*—Monica S Carter
*Assistant Examiner*—Stephanie Newton
(74) *Attorney, Agent, or Firm*—Kenneth B. Wood

(57) ABSTRACT

Applicant discloses a broom that comprises at least one particle capture sheet. In various embodiments, the particle capture sheet can comprise a nonwoven material, a woven material, a knitted material, or a synthetic polymeric membrane. The particle capture sheet can be air permeable or air impermeable, and can comprise an electret material and/or an adhesive.

20 Claims, 3 Drawing Sheets

BROOM WITH PARTICLE CAPTURE SHEET

BACKGROUND

Brooms are cleaning devices that have been in use for many years. Brooms most commonly have relatively stiff bristles (compared to, e.g., hand-held dusters), and are typically used dry, for dislodging particulate matter and small debris from a floor and propelling the particles and debris into a receptacle such as a dustbin. The use of a broom may dislodge and propel particles into the air that are so small as to not quickly settle back to the floor under the influence of gravity. Thus, an issue with brooms is that in the course of dislodging, collecting and disposing of large particles and debris, the use of a broom can result in small particles being dispersed into the air. Such small particles can comprise known allergens such as pollen, mold spores and the like.

SUMMARY

Applicant discloses a broom that comprises at least one particle capture sheet. Such a particle capture sheet may act to capture particles, particularly small particles such as dust, pollen and the like, that upon being dislodged from a surface by an act of sweeping might be dispersed into the air.

In one aspect, applicant discloses a broom with a particle capture sheet, comprising an elongated head having at least a long axis and a bottom major surface; an optional handle attached to the elongated head; a multiplicity of bristles attached to the bottom major surface of the elongated head and protruding downwardly therefrom; and, a particle capture sheet having first and second opposing major surfaces and a proximal end and a distal end, wherein the proximal end of the particle capture sheet is attached to the bottom major surface of the head and the capture sheet protrudes downwardly therefrom, wherein the particle capture sheet is oriented generally along the long axis of the elongated head, and wherein each opposing major surface of the particle capture sheet is positioned adjacent at least a portion of the multiplicity of bristles.

In another aspect, applicant discloses a broom with a particle capture sheet, comprising a head having at least a bottom major surface, an optional handle attached to the head; a multiplicity of bristles attached to the bottom major surface of the head and protruding downwardly therefrom; and, a particle capture sheet having first and second opposing major surfaces and a proximal end and a distal end, wherein the proximal end of the particle capture sheet is attached to the bottom major surface of the head and the capture sheet protrudes downwardly therefrom, wherein the particle capture sheet is selected from the group consisting of a nonwoven material, a woven material, a knitted material, and a synthetic polymeric membrane.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Like reference symbols in the various figures indicate like items. Figures and drawings in this document are not to scale and are chosen for the purpose of illustrating different exemplary embodiments of the invention.

DETAILED DESCRIPTION

Although terms such as "top", "bottom", "upper", "lower", "upward", "downward", "front" and "back", and "first" and "second" may be used in this disclosure, it should be understood that those terms are used in their relative sense only.

Broom Configuration

Figure 1:
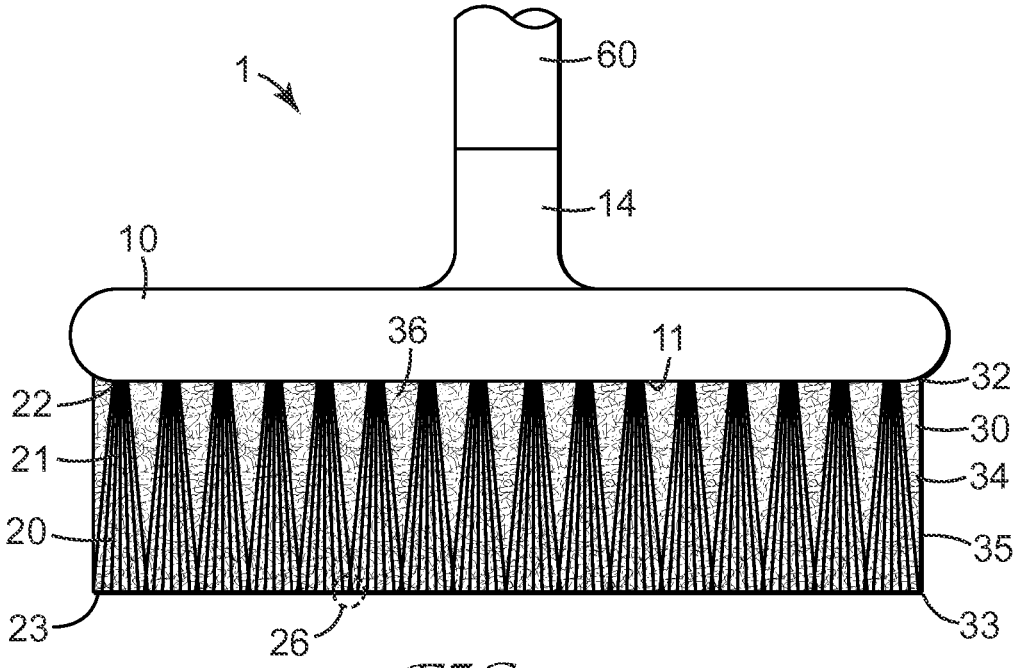
FIG. 1 is a side view of one embodiment of a broom comprising a particle capture sheet.
Figure 1A:
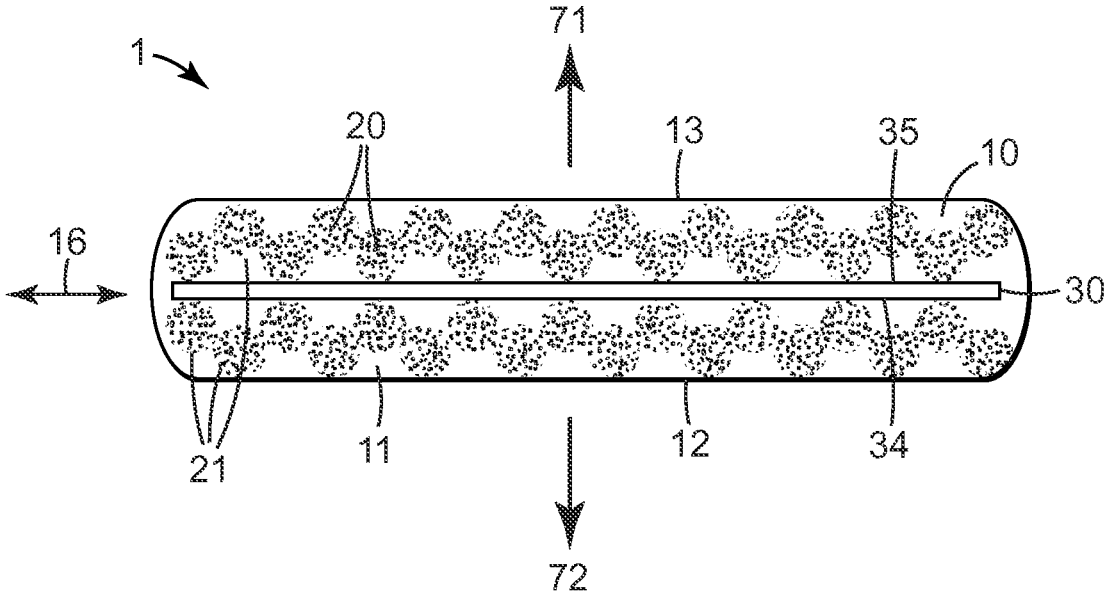
FIG. 1*a* is a bottom view of one embodiment of a broom comprising a particle capture sheet.

FIGS. 1 and 1*a* show one embodiment of a broom 1 comprising a head 10 to the bottom major surface 11 of which is attached a plurality of bristles 20. In one embodiment, broom head 10 comprises an elongated head. Broom 1 can be used with an optional long (e.g. one meter or more) handle 60 attached, so as to allow the broom to be used by a user in a standing position. Such a handle 60 can be permanently attached to head 10 (e.g. to the top major surface of the head at attachment location 14); or, it can be releasably attached to the head. In one common design, the handle and bristles are positioned such that the bristles are substantially aligned with the long axis of the attached handle. In another common design, (commonly referred to as a push broom), the handle and bristles are positioned such that the bristles are oriented at relatively large angle (e.g., 30 degrees or greater) to the long axis of the handle.

Broom 1 can also be used without an attached long handle 60. In this configuration (often called a whisk broom configuration) the broom can be operated by grasping an optional short handle (e.g. less than about 30 cm) attached to the broom head, or by grasping the broom head itself. To this end, the broom head may have a handle built into it (e.g. molded into the body of the head).

Broom 1 comprises at least one particle capture sheet 30. Such a sheet comprises first opposing major surface 34, second opposing major surface 35, proximal end 32, and distal end 33. Proximal end 32 of the particle capture sheet is attached to bottom major surface 11 of broom head 10, directly or indirectly, by any of several methods described below.

In one embodiment, sheet 30 is positioned in a straight line (as shown in the exemplary embodiment of FIG. 1*a*). In alternative embodiments, sheet 30 can be positioned in a serpentine, bent, zig-zag, or pleated manner; for example, in a serpentine pattern that winds between different bristle bundles.

In one embodiment, particle capture sheet 30 is aligned generally along the long axis 16 of elongated head 10. In this context, "aligned generally along the long axis" means that sheet 30 generally follows the direction of the long axis 16 of the broom head 10. This encompasses, for example, configurations in which sheet 30 is positioned at a slight angle to the long axis 10, and those in which sheet 30 comprises a sinusoidal or zig-zag pattern that generally follows the long axis 10 even though individual sections may deviate significantly from the direction of the long axis 10. The long axis 16 of head 10 may be straight, as in the exemplary embodiment of FIG. 1*a*; or, the long axis 16 may be curved, for example if elongated head 10 is curved or arc-shaped.

In one embodiment, each opposing major surface of capture sheet 30 is positioned adjacent at least a portion of the multiplicity of bristles 20. In this context, adjacent means in proximity to (e.g. within 4 cm of) and not separated from by the body of the capture sheet. For example, in the exemplary embodiment of FIG. 1*a*, at least a portion of the multiplicity of bristles 20 is positioned adjacent major surface 34 of sheet 30, and at least a portion of the multiplicity of bristles 20 is positioned adjacent major surface 35 of sheet 30. In this embodiment, sheet 30 is positioned so as to be able to capture particles dislodged by bristles during the act of sweeping, whether such sweeping occurs in direction 71 or direction 72 (as indicated in FIG. 1*a*). The relative proportion of bristles adjacent major surface 34, and adjacent major surface 35, may be chosen as desired. In the particular embodiment of FIG. 1*a*, sheet 30 is positioned symmetrically along the long axis 10 of the broom head with the multiplicity of bristles 20 being present in substantially equal proportions adjacent first major surface 34 and second major surface 35 of particle capture sheet 30.

Multiple particle capture sheets 30 can be employed, for example arranged in layers. In one embodiment, multiple sets of bristles can be provided extending along the long axis 16 of head 10, with one or more particle capture sheets 30 present between the sets of bristles.

In a particular embodiment, multiple layers of particle capture sheets 30 can be employed that are in a stacked configuration (without bristles in between the individual particle capture sheets), such that an outermost particle capture sheet 30 can be removed to expose a formerly underlying particle capture sheet.

In one embodiment, sheet 30 is about the same length and width as the length and width collectively exhibited by bristles 20 (e.g., as pictured in the exemplary embodiment of FIG. 1). For example, the distal end 33 of sheet 30 may be about the same distance from major surface 11 of head 10, as are distal ends 23 of bristles 20. In an alternate embodiment, sheet 30 comprises a shorter length and/or width than that collectively exhibited by the collection of bristles 20. For example, the distal end 33 of at least a portion of sheet 30 may be a somewhat shorter distance (e.g., at least 5, 10, or 20 mm shorter) from major surface 11 of head 10, than are distal ends 23 of at least some bristles 20. Such a recessed sheet position may result in the particle capture sheet being less likely to be damaged, abraded, etc., in the act of sweeping. In still another alternate embodiment, sheet 30 comprises a longer length and/or width than that collectively exhibited by the collection of bristles 20. For example, the distal end 33 of sheet 30 may be a somewhat greater distance (e.g., at least 5, 10, or 20 mm greater) from major surface 11 of head 10, than are distal ends 23 of bristles 20. Such a protruding sheet position may result in the particle capture sheet having greater ability to capture particles by direct contact of the sheet with the surface being swept.

In another embodiment, rather than sheet 30 being about the same length and width as that collectively exhibited by the collection of bristles 20, multiple smaller sheets are provided. For example, such sheets may be in the form of strips which have spaces in between, or they may comprise overlapping sheets.

Broom Head

Head 10 can be made of any suitable material, including metal, plastic, wood, and the like. Often, head 10 is a molded plastic material. Head 10 can comprise an attachment location (e.g. a molded cavity) 14 suitable to receive optional handle 60. Head 10 can comprise a generally elongated shape that may be straight, or arced or curved. An exemplary head that may be employed is pictured in U.S. Design patent application Ser. No. 29/250509 to Dotterman et al., filed Nov. 17, 2006.

Bristles

Bristles 20 are attached to bottom major surface 11 of head 10 in any conventional way. The bristles can be made of synthetic polymers such as polyester, polypropylene, nylon, and the like; or the bristles can comprise natural materials, e.g. straw. The bristles can also comprise an elastomeric material; for example a natural material such as natural rubber, or a synthetic material such as butyl rubber, styrene-butadiene rubber, etc. The bristles can be selected to have a combination of thickness (e.g., diameter, in the case of cylindrical bristles) and modulus such that the bristles are of appropriate strength and stiffness to be able to dislodge and propel debris. In various embodiments, the bristles comprise a thickness of at least about 0.1 mm, at least about 0.2 mm, or at least about 0.5 mm. In further embodiments, the bristles comprise a thickness of at most about 2 mm, at most about 1 mm, or at most about 0.7 mm.

In one embodiment, bristles 20 are present in bundles 21. Several such bundles can be provided in a spaced arrangement along the broom head as depicted in the exemplary embodiments of FIG. 1 and FIG. 1*a*. Each bundle can comprise a multiplicity (e.g., 5-25) of bristles, the proximal ends of which are all attached to head 10 in a common location 22. In one embodiment, at least some of the individual bristle bundles comprise a flared configuration in which the bristles in the bundle are compacted together at the point of attachment 22 of the bristles 20 to the broom head 10, with the distal ends 23 of the bristles allowed to remain loose. This allows the bristles in each bundle to spread such that near the distal end 23 of the bundles, at least some bristles in adjacent bundles are in contact with each other (e.g., at point 26 in FIG. 1). However, near the proximal ends 22 of the bundles, the bristles in adjacent bundles are not in contact with other, thus at least some portion of major surfaces 34 and/or 35 of particle capture sheet 30 is not covered by bristles (e.g. area 36 of FIG. 1). Such a bristle configuration minimizes gaps between the bristles 20 at the distal ends 23 of the bristles (so as to provide the most complete and uniform coverage in sweeping), while at the same time ensuring that at least a portion of major surfaces 34 and/or 35 of particle capture sheet 30 is not covered, blocked, or obstructed by the bristles 20, thus enhancing the ability of the particle capture sheet 30 to encounter and capture airborne particles.

Particle Capture Sheet

Particle capture sheet 30 can comprise any sheetlike material that can capture particles, particularly fine particles such as pollen and the like, that may be dislodged from a surface in the act of sweeping. In this context, "sheet" means a flexible article having a thickness that is much less than the length or width of the article (e.g., less by a factor of 5). In various embodiments, the thickness of the sheet is less than about 5 mm, less than about 3 mm, or less than about 2 mm.

In one embodiment, particle capture sheet 30 is impermeable to air, e.g., it has a sufficiently high air flow resistance to essentially prevent the passage of air through it. In such a case, capture of airborne particles may occur primarily by impingement of particle-carrying air against the surface of the particle capture sheet (either by movement of the broom through the air, by air currents moving the air against the sheet, or by random diffusion of particles through the air). Such air-impermeable sheets may comprise solid materials, or may comprise fibrous materials of sufficiently dense or compacted structure, as described in detail below.

In an alternative embodiment, particle capture sheet 30 is permeable to air, e.g., it has a sufficiently low air flow resistance so as to allow air flow through it. In such a case, capture of airborne particles may occur by impingement of particle-carrying air against the surface of the particle capture sheet and/or by the flow of particle-carrying air through the capture sheet. In various embodiments, particle capture sheet 30 comprises an air-flow resistance of less than about 20 mm $H_20$, less than about 10 mm $H_20$, or less than about 6 mm $H_20$, when measured at a face velocity of 98.4 meters/minute, using the method outlined in U.S. Pat. No. 5,792,242 to Haskett.

Capture of particles can occur by entrapment of the particles by the sheet material. For example, if the sheet is a nonwoven material, capture can occur by entrapment of the particles in the fibrous structure of the nonwoven material. Such entrapment can occur on the surface of the sheet or within the interior of the sheet. In embodiments in which the sheet comprises a material that possesses permanent or persistent electric charges (e.g., an electret material), the particle capture can also occur via electrostatic attraction of the particle to the charged material. In embodiments in which the sheet comprises adhesive, capture can also occur via the particle sticking to adhesive that is present on the surface of the sheet or in the interior of the sheet. In certain embodiments, any or all of these types of capture may occur. Airborne particles may come in contact with the sheet for capture via air impinging on the capture sheet and/or via air flowing through the capture sheet, as discussed above. Capture may also occur via direct contact of the capture sheet with particles on a surface, without the particles becoming airborne.

Particle capture sheet 30 can capture particles permanently, such that the sheet is disposed of and/or replaced after sufficient use. In an alternative embodiment, the sheet is washable such that particles may be removed and the sheet used again. In either case, the sheet should capture particles strongly enough that a significant amount of particles are not dislodged from the sheet by continued sweeping.

Particle capture sheet 30 can comprise any material that is capable of capturing fine particles. In one embodiment, particle capture sheet comprises a porous material, including, but not limited to, synthetic polymeric membranes such as phase inversion membranes, expanded polytetrafluoroethylene membranes, track-etched membranes, and the like; cellulosic membranes such as filter paper; open-cell foams such as polyurethane and polypropylene foams; and inorganic fibrous materials such as fiberglass and rockwool.

In one embodiment, the particle capture sheet comprises a fibrous material. In various embodiments, the fibrous material may comprise knitted, woven or nonwoven materials based on natural or synthetic fibers or a combination thereof. In this context, the term nonwoven denotes a fibrous material having at least in part a structure of individual fibers that are entangled but not necessarily in a regular or identifiable pattern as in a knitted or woven fabric. Such a nonwoven web may be prepared by any suitable melt forming or mechanical operation. For example, the nonwoven web may be carded, spunbonded, spunlaced, melt blown, air laid, creped, or made by other processes known in the art. In one embodiment, the nonwoven is porous. In certain embodiments, the nonwoven material may be partially densified and/or may comprise a densified layer.

In one embodiment, the particle capture sheet comprises a charged material. Such materials include those known as electrets, in which a persistent electric charge is placed on meltblown fibers of a nonwoven web to improve their capturing efficiency, using methods such as those described in e.g. U.S. Pat. No. 4,215,682 to Kubik et al. Nonwoven webs comprising electret fibers, and methods of making thereof, are further described in U.S. Pat. No. 5,792,242 to Haskett.

In one embodiment, particle capture sheet 30 comprises a nonwoven that comprises at least one additional optional layer of material. Such a layer may serve, for example, as a reinforcing layer, and may be placed inside layers of the nonwoven that comprise sheet 30. Or, such an additional layer may be provided externally, on one or both major surfaces of sheet 30. Such an external layer (e.g., a scrim) may also serve to protect the capture sheet from damage, abrasion, etc. It may be advantageous for an internal or external optional layer to exhibit high air permeability. For example, the layer may comprise a mesh or netting. Exemplary support layers (e.g., scrims) that may be suitable are described in U.S. Pat. No. 5,792,242 to Haskett.

In various embodiments, particle capture sheet 30 can comprise additives of various types, for example, sorbent materials such as activated carbon, charcoal, zeolites, and the like (that can act to capture odorous materials); fragrances; antibacterial agents; waxes; oils; tacky polymeric additives, etc. If the particle capture sheet is to comprise an electret material, electret charging enhancement additives (e.g., tristearyl melamine, and various materials such as products 119 and 944 available under the trademark CHIMASSORB from Ciba Specialty Chemicals of Basel, Switzerland) can be used. Such additives can comprise particulate additives or can be added, for example, by melt addition of the additive to a material that is used to form a nonwoven particle capture sheet material.

Adhesive

In one embodiment, particle capture sheet 30 comprises adhesive that aids in particle capture. In one embodiment, the particle capture sheet comprises an air-impermeable sheet, (e.g. a solid sheet, or a fibrous sheet of sufficiently high fiber density, or containing a densified layer, such that the material is substantially air-impermeable) that is coated over at least a portion of the sheet with adhesive, e.g. a pressure sensitive adhesive.

In an alternative embodiment, particle capture sheet comprises an air-permeable sheet, for example a material of the type described above, that comprises adhesive. Such adhesive can be present one or both major surfaces of the sheet, can be distributed throughout the interior of the sheet, or can be in all these locations.

In one embodiment, particle capture sheet 30 comprises a fibrous material (e.g. a nonwoven) that contains adhesive. Such adhesive can be present on the surface of the sheet and/or the adhesive can be impregnated into the interior of the sheet. Such sheets can be produced, for example, by forming a nonwoven sheet material and depositing an adhesive material thereon or therein by a process such as spray coating, roll coating, etc. Nonwoven materials comprising adhesive that may be useful in the present application include, for example, those described in U.S. Patent Application Publication 2003/0171051 to Bergsten et al., and those described in U.S. Patent Application Publication 2006/0240223 to Tuman and Haskett.

The adhesive can be deposited over the entirety of particle capture sheet 30, or over a portion thereof, and can be deposited in a pattern (stripes, dots, etc.) if desired.

Attachment of Sheet to Broom

The particle capture sheet 30 may be provided as a largely unsupported sheet that is attached by its end to broom head 10. In such case, proximal end 32 of sheet 30 may be attached directly to head 10, or may be attached to a member (e.g. a flange, ridge, etc.) or set of members that are attached to, or are part of, head 10. Particle capture sheet 30 may be permanently attached to head 10 or to any part thereof by any suitable attachment method such as adhesive bonding, ultrasonic bonding, stapling, and so on. (in this context, permanently attached means that sheet 30 may not be detached without destroying sheet 30). Particle capture sheet may be removably attached to head 10 or any part thereof by any suitable method, including, for example, mechanical fastening systems such as hook and loop fasteners, snaps, clips, and the like.

In an alternative embodiment, sheet 30 is attached to a support rail 40, which is in turn attached to broom head 10. Support rail 40 can comprise any material to which particle capture sheet 30 can be attached and that has sufficient strength. For example, rail 40 can comprise a molded plastic, a stiff or reinforced cardboard material, and the like.

Figure 2:
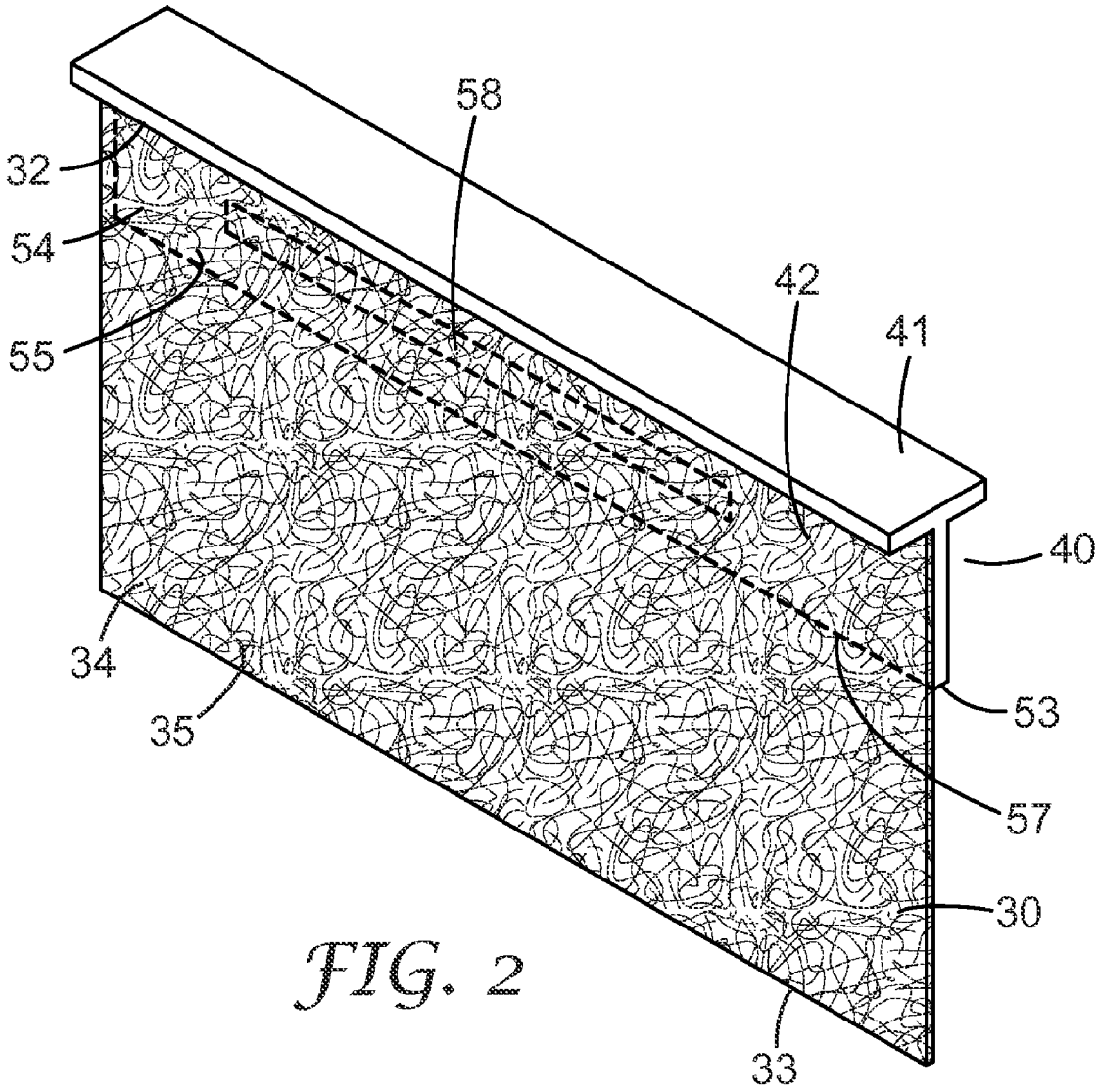
FIG. 2 is a perspective view of one embodiment of a particle capture sheet.
Figure 3:
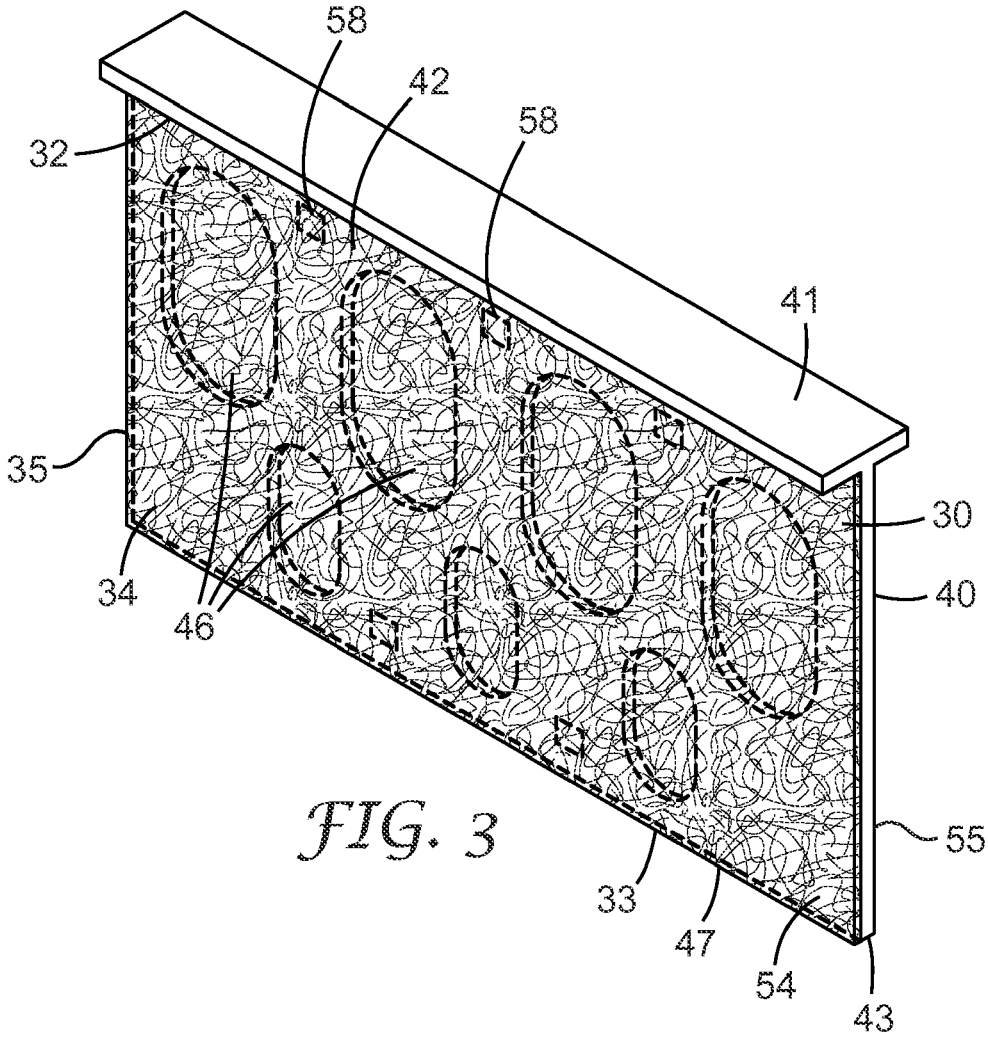
FIG. 3 is a perspective view of another embodiment of a particle capture sheet.

In one embodiment support rail 40 comprises a base portion 41 to which particle capture sheet 30 is attached. In another embodiment support rail 40 comprises a base portion 41 and a downwardly protruding portion 42, exemplary embodiments of which are shown in FIGS. 2 and 3. In these embodiments, sheet 30 is attached to rail 40 by bonding second major surface 35 of sheet 30 to first major surface 54 of downwardly protruding portion 42. If desired, two layers of particle capture sheet can be provided, by attaching a second particle capture sheet 30 to rail 40 by bonding a major surface of the second sheet to the second major surface 55 of portion 42. Or, two layers of particle capture sheet can be provided by attaching a single, folded sheet to first major surface 54 and second major surface 55 of portion 42. Such a folded sheet may comprise a folded edge at distal end 33.

Sheet 30 may be permanently attached to rail 40 (in this context, permanently means that sheet 30 may not be detached without destroying sheet 30 and/or rail 40). Sheet 30 may be so attached via any suitable method (e.g. adhesive bonding, melt-bonding, ultrasonic bonding, etc.). In another embodiment, sheet 30 is removably attached to support rail 40, for example by clamping, double-faced adhesive, or hook and loop fastener. In one embodiment, bonding is achieved by providing on first major surface 54 of portion 42 at least one hook area 58 comprising hooks of the type used in hook and loop fastening systems. Several discrete areas 58 comprising hooks may be provided at various locations on first major surface 54 of portion 42; or, the entirety of the first major surface of portion 42 may comprise hooks. A corresponding loop structure is attached to sheet 30 (e.g. by adhesive bonding, melt bonding, sewing, etc.) such that sheet 30 can be removably attached to support rail 40. In an alternative embodiment, sheet 30 comprises a fibrous material of properties such that sheet 30 itself functions as the loop component of a hook and loop fastener. In such a case, an added loop structure is not needed.

Figure 4:
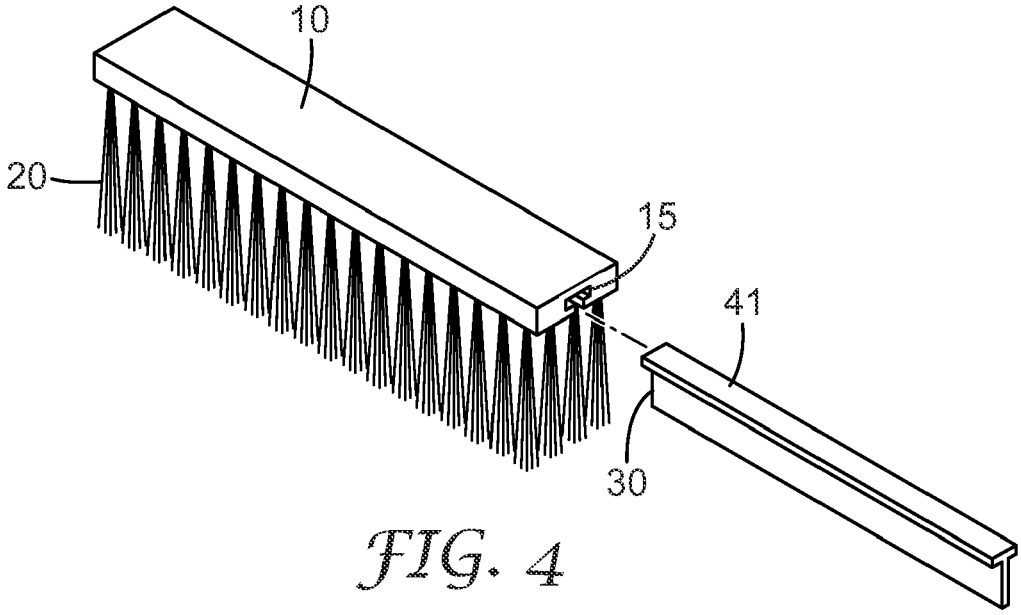
FIG. 4 is a perspective view of a broom and a particle capture sheet attached to a support rail, shown removed from the broom head.

Support rail 40 can be attached to broom head 10 by any known method, including mechanical devices such as staples, screws, clamps etc.; adhesives; melt-bonding; ultrasonic bonding and the like. Support rail 40 can be attached to head 10 permanently, or removably (for example, by use of hook and loop fastener; by use of the mechanical fastening system available under the tradename DUAL-LOCK from 3M Company of St. Paul, Minn.; by use of double faced adhesive products such as that available under the tradename COMMAND from 3M Company of St. Paul, Minn.; etc.). In the exemplary embodiment of FIG. 4, head 10 is provided with a channel 15 that is oriented along the long axis 16 of the head, into which base portion 41 of rail 40 can be slidably inserted and removed. Such a configuration is facilitated by providing fiber bundles 21 in at least two spatially separated sets (as pictured in FIG. 1*a*), each extending generally along the long axis 16 of head 10, with sufficient space in between the sets such that particle capture sheet 30 can slide between the fiber bundle sets as rail 40 is inserted into channel 15.

Various support rail configurations are possible, including for example a support rail 40 that comprises only a base portion 41 (e.g. lacking a downwardly protruding portion) to which sheet 30 is directly attached. Or, support rail 40 can comprise a downwardly protruding portion 42.

In the exemplary embodiment shown in FIG. 2, downwardly protruding portion 42 comprises a downwardly protruding stub portion 53, that may extend a desired distance from base 41 (for example, such that stub distal end 57 is at most 5, 10, or 20 mm from surface 11 of head 10 when rail 40 is attached to head 10). In this configuration, at least a portion of particle capture sheet 30 may protrude sufficiently far past terminal end 57 of stub portion 53 that the protruding portion of sheet 30 is free to move, bend, etc.

In the exemplary embodiment shown in FIG. 3, downwardly protruding portion 42 comprises a frame portion 43. Such a frame portion can provide structural support to the particle capture sheet; for example, it can provide structural support to at least a majority of the area of the particle capture sheet (notwithstanding the presence of perforations, as discussed below). Distal end 47 of frame portion 43 may be positioned even with or near (i.e. within 0-3 mm of) distal end 33 of sheet 30; alternatively, it may be recessed a distance (e.g. 4-10 mm) from distal end 33. Distal end 47 of frame portion 43 may be positioned such that when the rail is attached to the broom, distal end 47 of frame portion 43 is near distal ends 23 of bristles 20; alternatively, it may be recessed a distance (e.g. 4-10 mm) from distal ends 23.

In one embodiment, protruding frame portion 43 of rail 40 is perforated. Such a configuration may be advantageous (in allowing air flow) in the use of a particle capture sheet 30 that is air permeable. Such a configuration may also be advantageous if only one layer of particle capture sheet 30 is used (irregardless of whether capture sheet 30 is air-permeable). In this case, perforated areas 46 of protruding frame portion 43 allow exposure of areas of the second major surface 35 of particle capture sheet 30 that would otherwise be obstructed by the frame material, thus possibly enhancing the efficiency of particle capture.

Perforated areas 46 may be relatively large and few in number, as illustrated in the exemplary embodiment of FIG. 3. Alternatively, the perforated areas can be smaller and more numerous (for example, a lattice, screen, or honeycomb structure can be used). The size and location of the perforated areas may be chosen so as to provide the greatest possible exposure of major surface 35 of particle capture sheet 30, while maintaining sufficient strength and stiffness of the frame. Even if perforations are present, protruding frame portion 43 can still provide structural support to at least a majority of the area of the particle capture sheet, e.g. by providing support at least to the periphery of this majority area.

A number of embodiments have been described in this disclosure. Nevertheless, it will be understood that various modifications may be made without departing from the invention. Accordingly, other embodiments are within the scope of the following claims.

What is claimed is:

1. A broom with a particle capture sheet, comprising:

an elongated head having at least a long axis and a bottom major surface;

an optional handle attached to the elongated head;

a multiplicity of bristles attached to the bottom major surface of the elongated head and protruding downwardly therefrom; and, a particle capture sheet that is porous and that has first and second opposing major surfaces and an interior and a proximal end and a distal end, wherein the proximal end of the particle capture sheet is attached to the bottom major surface of the head and the capture sheet protrudes downwardly therefrom, wherein the particle capture sheet is oriented generally along the long axis of the elongated head, and wherein each opposing major surface of the particle capture sheet is positioned adjacent at least a portion of the multiplicity of bristles, and wherein the particle capture sheet serves to entrap at least some of the particles within the interior of the particle capture sheet such that the particles are not dislodged from the sheet by continued use of the broom.

2. The article of claim 1 wherein the particle capture sheet is selected from the group consisting of a nonwoven material, a woven material, a knitted material, and a synthetic polymeric membrane.

3. The article of claim 1 wherein the particle capture sheet is air permeable.

4. The article of claim 1 wherein the capture sheet comprises electret material.

5. The article of claim 1 wherein the capture sheet comprises adhesive.

6. The article of claim 1 wherein the capture sheet is removably attached to the elongated head.

7. The article of claim 1 wherein the capture sheet is attached to a support rail that is removably attached to the elongated head.

8. The article of claim 7 wherein the support rail comprises a base that is slidably insertable into a channel that is present in the elongated head and aligned along the long axis of the elongated head.

9. The article of claim 7 wherein the support rail comprises a downwardly protruding, perforated frame portion that provides structural support to at least a majority of an area of the particle capture sheet.

10. The article of claim 1 wherein the particle capture sheet is oriented along the long axis of the elongated head and wherein the bristles are present in substantially equal proportions in proximity to the first and second major surfaces of the particle capture sheet.

11. The article of claim 1 wherein the bristles are arranged in bundles comprising proximal and distal ends and that are attached to the bottom major surface of the elongated head at the proximal end of the bristle bundles;

wherein at least some of the bristle bundles comprise a flared configuration such that near the proximal end of the bundles the bristles in adjacent bundles are not in contact with each other, and such that near the distal end of the bundles at least some bristles in adjacent bundles are in contact with each other; and, wherein at least a portion of at least one major surface of the capture sheet is not covered by bristles.

12. A broom with a particle capture sheet, comprising:

a head having at least a bottom major surface, an optional handle attached to the head;

a multiplicity of bristles attached to the bottom major surface of the head and protruding downwardly therefrom; and, a particle capture sheet that is porous and that has first and second opposing major surfaces and an interior and a proximal end and a distal end, wherein the proximal end of the particle capture sheet is attached to the bottom major surface of the head and the capture sheet protrudes downwardly therefrom, wherein the particle capture sheet is selected from the group consisting of a nonwoven material, a woven material, a knitted material, and a synthetic polymeric membrane, and wherein the particle capture sheet serves to entrap at least some of the particles within the interior of the particle capture sheet such that the particles are not dislodged from the sheet by continued use of the broom.

13. The article of claim 12 wherein the particle capture sheet is air permeable.

14. The article of claim 12 wherein the capture sheet comprises electret material.

15. The article of claim 12 wherein the capture sheet comprises adhesive.

16. The article of claim 12 wherein the capture sheet is removably attached to the head.

17. The article of claim 12 wherein the capture sheet is attached to a support rail that is removably attached to the head.

18. The article of claim 17 wherein the support rail comprises a downwardly protruding, perforated frame portion that provides structural support to at least a majority of an area of the particle capture sheet.

19. The article of claim 12 wherein the bristles comprise a proximal end and a distal end and wherein the bristles are attached to the bottom major surface of the elongated head at the proximal end of the bristles, and wherein the proximal end of at least a portion of the particle capture sheet is a shorter distance from the bottom major surface of the head than is the proximal end of at least some of the bristles.

20. The article of claim 12 wherein the bristles are arranged in bundles comprising proximal and distal ends and that are attached to the bottom major surface of the head at the proximal end of the bristle bundles;

wherein at least some of the bristle bundles comprise a flared configuration such that near the proximal end of the bundles the bristles in adjacent bundles are not in contact with each other, and such that near the distal end of the bundles at least some bristles in adjacent bundles are in contact with each other; and, wherein at least a portion of at least one major surface of the capture sheet is not covered by bristles.

* * * * *

UNITED STATES PATENT AND TRADEMARK OFFICE

CERTIFICATE OF CORRECTION

PATENT NO. : 7,836,540 B2
APPLICATION NO. : 11/832752
DATED : November 23, 2010
INVENTOR(S) : Lloyd S Vasilakes It is certified that error appears in the above-identified patent and that said Letters Patent is hereby corrected as shown below:

On the Title Page, Item (56) (U.S. Patent Documents)
Line 15, delete "2005/0171051 A1 8/2005 Bergsten et al." and insert
-- 2003/0171051 A1 9/2003 Bergsten et al. --, therefor.

Signed and Sealed this
Twenty-ninth Day of May, 2012

David J. Kappos

David J. Kappos
*Director of the United States Patent and Trademark Office*